United States Patent [19]

Junkers

[11] Patent Number: 5,016,502

[45] Date of Patent: May 21, 1991

[54] POWER WRENCH

[76] Inventor: John K. Junkers, 7 Arrowhead Ln., Saddle River, N.J. 07458

[21] Appl. No.: 502,545

[22] Filed: Mar. 30, 1990

[51] Int. Cl.[5] ..... B25B 13/46

[52] U.S. Cl. ..... 81/57.39

[58] Field of Search ..... 81/57.39, 57.4

[56] References Cited

U.S. PATENT DOCUMENTS

| | | | |
|---|---|---|---|
| 4,409,865 | 10/1983 | Krautter et al. | 81/57.39 |
| 4,644,829 | 2/1987 | Junkers | 81/57.39 |
| 4,706,526 | 11/1987 | Junkers | 81/57.39 |
| 4,706,527 | 11/1987 | Junkers | 81/57.39 |
| 4,921,010 | 5/1990 | Spirer | 137/580 |

*Primary Examiner*—James G. Smith

*Attorney, Agent, or Firm*—Michael J. Striker

[57] ABSTRACT

A power wrench for tightening and loosening of threaded connectors comprises fluid operated drive units including a cylinder and a piston movable in the cylinder and having an end, engaging units arranged to engage and turn a threaded connector for tightening or loosening the latter, a ratchet-pawl mechanism including a ratchet provided in the engaging units and at least two pawls arranged to engage different teeth of the ratchet for turning the ratchet in opposite directions, and units for connecting the drive units witht he pawls and including at least two levers both pivotally connected to the end of the piston and turnable about different axes and each connected with a respective one of the pawls.

18 Claims, 2 Drawing Sheets

POWER WRENCH

BACKGROUND OF THE INVENTION

The present invention to power tools, and more particularly to fluid operated wrenches, such as for example hydraulic wrenches.

The basic problem in developing of such fluid-operated wrenches has always been to make the tools smaller so that it would fit into more applications, and also lighter because the tool has to be carried by an operator. One problem has always been that the tool housing, due to its L-shaped configuration, is in the way for doing many various jobs. Many hydraulic torque tools have been developed in an attempt to reduce the overall size by reducing the stroke of the tool. This required putting more teeth on the ratchet which, however, was not found to be as reliable as the ratchets with less teeth. It is believed to be clear that further improvement of the above mentioned tools are desirable.

SUMMARY OF THE INVENTION

Accordingly, it is an object of the present invention to provide a power wrench which overcomes the disadvantages of the prior art.

More particularly it is an object of the present invention to provide a power wrench which is smaller and lighter than existing power wrenches of the above mentioned type.

In keeping with these objects and with others which will become apparent hereinafter, one feature of the present invention resides, briefly stated, a power wrench having power drive means with a fluid operated cylinder-piston unit, engaging means for engaging a threaded connector to be tightened and loosened, a ratchet mechanism with a ratchet provided in the engaging means and two pawls engaging different teeth of said ratchet, and two independent levers both connected to an end of the piston of the cylinder-piston unit, pivotable about two different axes spaced from one another, and each connected with a respective one of said pawls.

When the power wrench is designed in accordance with the present invention, it eliminates the disadvantages of the prior art and provides for a smaller and lighter construction which is advantageous to be used in various applications and to be carried by an operator.

The levers and the pawls are designed so that during the forward stroke the pawl of one lever is operatively connected with the ratchet and pawl of the other lever slides backward, while during the return or rearward stroke the pawl of the other lever is operatively connected with the ratchet while the pawl of the one lever slides rearwards. Since one pawl makes the ratchet move forwards and the other pawl slides backwards, only half a stroke is necessary to achieve a full stroke in a forward/backward direction.

In the prior art power tools having a forward/backward mechanisms, the disadvantage was that the power ratio of the two pawls was different, to accommodate for the difference in the area and thus in the force between the advance piston area and the retract piston area containing the piston rods. In accordance with the present invention, both piston areas are equal. The piston has two piston rods having identical cross-sections and guided in identical guides of the cylinder. This allows the use of an equal ratio on both levers and thus an equal stroke (movement of the ratchet) in either advancing or retracting direction.

Still another feature of the present invention is that the housing of the tool is wedge-shaped in direction toward the ratchet, as opposed to an L-shaped tool. This shape provides for many more possibilities of fitting the tool for various applications.

It is also an important feature of the present invention that the tool is provided with a connector for connecting a fluid source to the cylinder of the power drive, wherein the connector is swivellable by 360° around the housing of the tool or the cylinder of the power drive means, and also 360° about an axis extending perpendicularly to the axis of the power drive. This provides for convenience of connecting the tool to a source of fluid medium and manipulating the tool in any direction without interfering with the fluid medium supplying hoses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
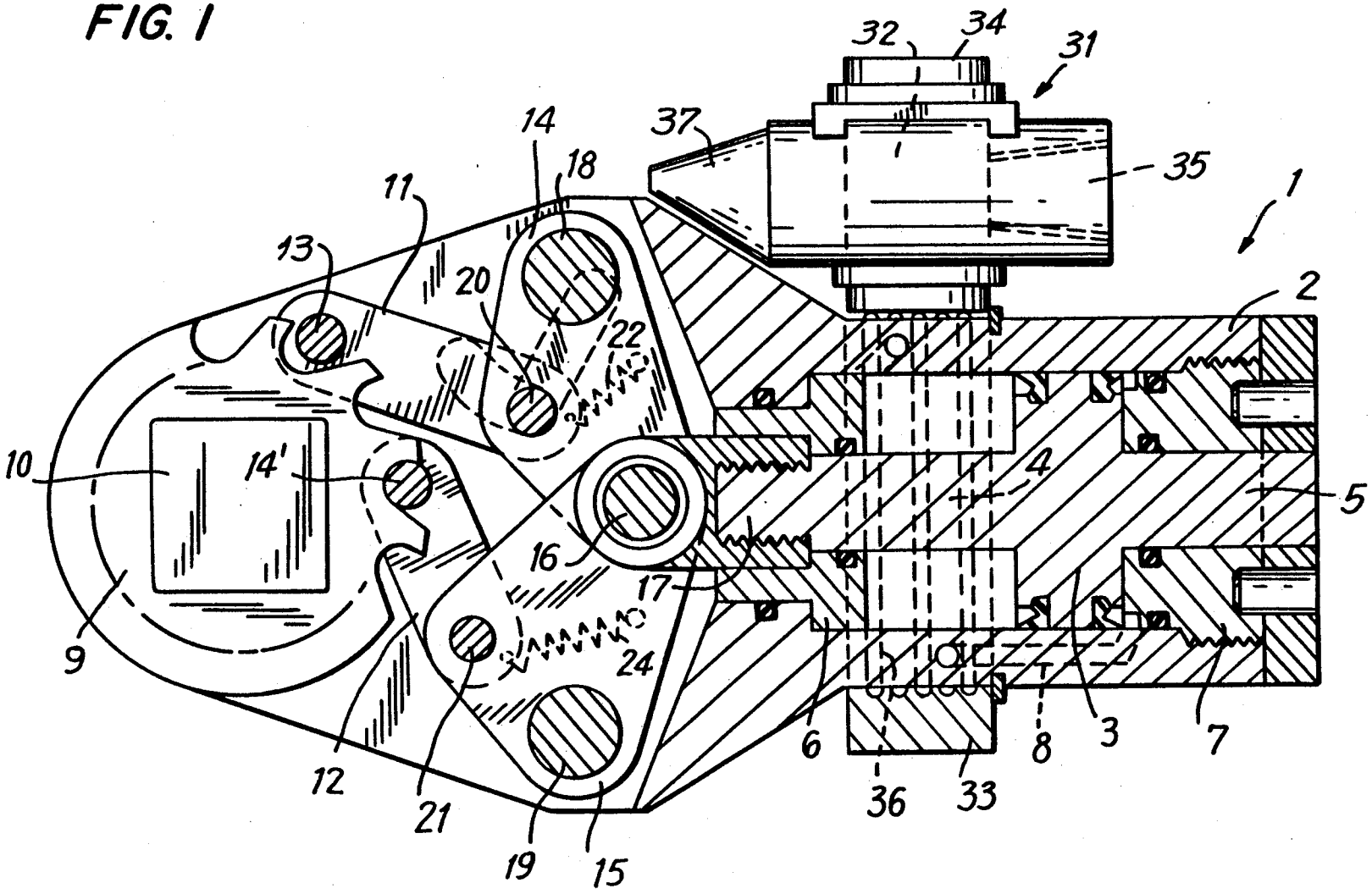
FIG. 1 is a side view of power wrench in accordance with the present invention.
Figure 2:
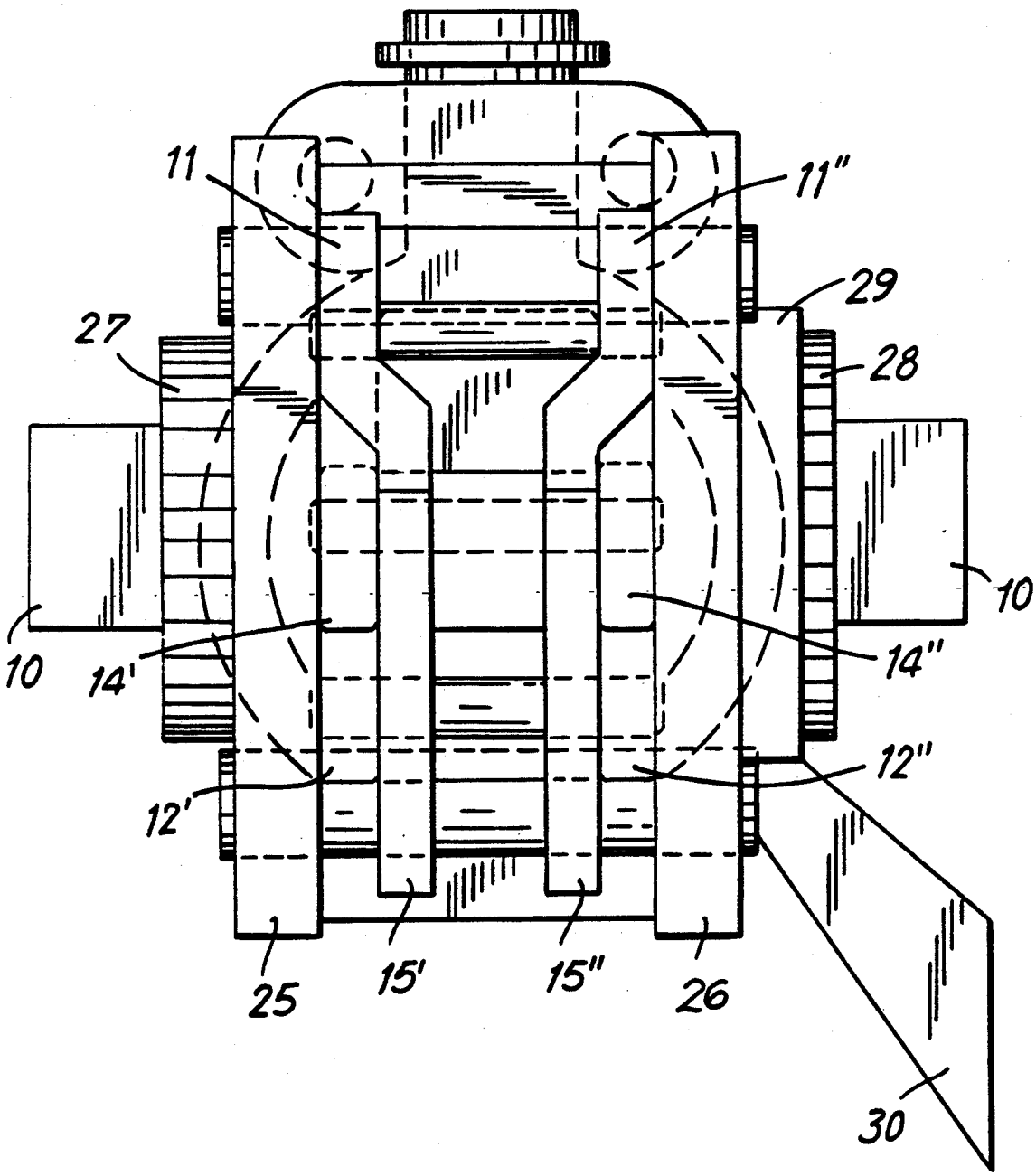
FIG. 2 is an end view of the inventive power wrench without a ratchet.

A power wrench in accordance with the present invention is shown in an example as a fluid-operated power wrench, for example a hydraulic wrench. The tool has power drive means identified as a whole with reference numeral 1. The power drive means is formed as a cylinder-piston unit which has a cylinder 2 and a piston 3 reciprocatingly movable in the cylinder 2. Two piston rods 4 and 5 extend from opposite axial ends of the piston 3 and are guided in guiding portions of the cylinder 2 which can be formed as additional elements 6 and 7. The cross-sections of the piston rods 4, 5 and guiding openings of the guiding portions 6, 7 are identical. A passage 4 is formed in the wall of the cylinder 2 and has two end openings which open into a cylinder chamber at both axial sides of the piston 3.

The tool is provided with engaging means for engaging a threaded connector to be tightened or loosened. In the shown embodiment the engaging means includes a ratchet 9 provided with a projection 10. Standard sockets can be attached to the projection 10 for engaging a threaded connector, such as a nut, a bolt head, etc. On the other hand, the ratchet 9 can be provided with a central, for example hexagonal opening for engaging the nut, the bolt head, etc.

The ratchet 9 is provided with a plurality of teeth on its periphery and forms a part of a ratchet mechanism. The ratchet mechanism further includes two pawls 11 and 12. Each pawl 11, 12 is composed of two pawl plates 11' and 11'' and 12' and 12''. The pawl plates of each pawl are spaced from one another. The pawl plates 11', 11'' of the pawl 11 are curved, while the pawl plates 12' and 12'' of the pawl 12 are straight. The pawl plates 12' and 12'' surround the ratchet at both axial sides thereof, and also the portions of the pawl plates 11', 11" which are spaced from one another farther also surround the ratchet at both axial sides. The free ends of the pawl plates 11' and 11" of the pawl 11 are connected with one another by a pin 13 which forms a tooth of the pawl 11. The pin 13 engages with the teeth of the ratchet 9. In turn, the pawl plates 12' and 12" are connected with one another at its free ends by a pivot pin 14 which also forms a tooth of the pawl 12 and engages with the teeth of the ratchet.

The tool is further provided with two levers 14 and 15. Each lever 14, 15 includes two lever plates 14', 14" and 15', 15". One end of the levers 14 and 15 is pivotally connected by a pivot pin 16 with an end of the piston rod 4, or more particularly, with a piece 17 attached to the end of the piston rod 4. The levers 14 and 15 are pivotally connected with a housing of the tool by pivot pins 18 and 19. The plates 14 and 15 are also pivotally connected with opposite ends of the pawls 11 and 12 by pivot pins 20 and 21. The pawls 11 and 12 are spring biased into engagement with the ratchet 9 by springs 22 and 23 each having one end attached to one pawl and the other end attached to a respective one of the levers.

The distance between the center a of the pivot pin 18 of the lever 14 and the center c of the pivot pin 16 connecting the levers to the piston rod 4 is equal to the distance between the center b of the pivot pin 19 of the lever 15 and the center c of the pivot pin 16. Also, the distance between the center a of the pivot pin 18 and the center a' of the pivot pin 20 is equal to the distance between the center b of the pivot pin 19 and the center b' of the pivot pin 21.

The levers 14 and 15, the pawls 11 and 12, and the ratchet 9 are sandwiched between housing plates 25 and 26 which together form a housing of the tool. The housing plates 25, 26 can be made of one piece with a wall of the cylinder 2 or connected to it in a conventional way, for example by welding. Each plate is provided with a splined hollow projections 27 and 28.

The tool is further provided with an abutment member for abutting during tightening or loosening a threaded connector against a neighboring object and therefore absorbing reaction forces. The abutment member includes a cylindrical portion 29 provided with inner splines and an arm-shaped portion 30 extending radially and axially from the cylindrical portion. The reaction member can be fitted with the cylindrical portion 29 on the hollow projection 27 or 28 of its inner splines with the outer splines of the projection in any position in the area of 360° around the axes of the projections so that the portion 30 can extend at any side of the engaging formation 10 of the engaging means.

Finally, the tool is provided with a connector 31 for connecting a source of a working fluid with an inner chamber of the cylinder 2 of the drive means. The connector includes two parts 32 and 33. The part 33 is substantially cylindrical and has an inner hole with which it is arranged on the cylindrical wall of the cylinder 2 of the drive means. It has a projection 34 extending upwardly in FIG. 1, and the part 32 is swivellably arranged on the projection 34 for turning about an axis extending perpendicular to the axis of the drive. The part 32 has two inlets 35 to be connected to hoses which lead to a not shown source of a working fluid. The part 33 has a plurality of grooves on the inner wall of its opening, which open into the inner chamber of the cylinder 2. Not shown passages communicate the inlets 35 of the part 32 with the grooves 36 of the part 33. A not shwon relief valve is located in the projection 37 of the part 33. Such connector is disclosed in U.S. patent application Ser. No. 183,565. The part 33 is swivellably mounted on the cylinder 2. Thus, the connector as a whole is turnable about the axis of the drive means and the perpendicular axis. As a result, it is very simple to connect the connector by the hoses to the source of the working fluid, and at the same time the hoses do not get entangled regardless of the position of the tool during tightening or loosening a threaded connector.

As can be seen from the drawings, the tool as a whole has a wedge-shape in contrast to the known L-shaped tools. The wedge-shape narrows toward the ratchet of the tool.

The power wrench in accordance with the present invention operates in the following manner. When a working fluid is admitted through the connector 31 into the inner chamber of the cylinder 2 of the power drive at the right side of the piston 3, the piston 3 together with the piston rod 4 moves to the left in the drawings and the end of the piston rod 4 turns the plate 14 in a clockwise direction and as a result, turns the pawl 11 which in turn, turns the ratchet 9 in a counterclockwise direction so as to turn a threaded connector. When then the working fluid is admitted into the inner chamber of the cylinder 2 at the left side of the piston 3, the piston 3 together with the piston rod moves to the right in the drawings and pulls the plate 15 in a clockwise direction, so that the plate 15 pushes the pawl 12 which in turn turns the ratchet 9 again in the counterclockwise direction. During the above mentioned forward stroke of the piston the pawl 12 just slides over the teeth of the ratchet, and during the backward stroke the pawl 11 slides over the teeth of the ratchet.

It will be understood that each of the elements described above, or two or more together, may also find a useful application in other types of constructions differing from the types described above.

While the invention has been illustrated and described as embodied in a power wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A power wrench for tightening and loosening of threaded connectors, comprising fluid operated drive means including a cylinder and a piston movable in said cylinder and having an end and an axis; engaging means arranged to engage and turn a threaded connector for tightening or loosening the latter; a ratchet-pawl mechanism including a ratchet provided in said engaging means and at least two pawls arranged to engage different teeth of said ratchet for turning said ratchet; and means for connecting said drive means with said pawls and including at lest two levers both pivotally connected to said end of said piston and turnable about different axes and each connected with a respective one of said pawls, said levers being located at opposite sides of said axis of said piston.

2. A power wrench as defined in claim 1, wherein said levers and said pawls are arranged so that during a forward stroke of said piston one of said pawls is operatively connected with said ratchet while the other of said pawls slides backwards, while during a rearward stroke of said piston said other pawl is operatively connected with the ratchet while said one pawl slides backwards, to produce a working stroke of said ratchet during said forward stroke and said rearward stroke of said piston.

3. A power wrench as defined in claim 1, wherein said piston is provided with a piston rod having said one end, said levers being pivotally connected with said one end of said piston rod.

4. A power wrench as defined in claim 3, wherein said piston is provided with a second piston rod located at opposite side of said first piston rod, said cylinder having two guiding portions each guiding a respective one of said piston rods.

5. A power wrench as defined in claim 1, wherein said piston rods and said guiding portions have an identical cross-section.

6. A power wrench as defined in claim 1, wherein said levers are connected with said one end of said piston in a first point, each of said levers being turnable about its axis located in a second point and connected with a respective one of said pawls in a third point, a distance between said first point and said second point of one of said levers being equal to a distance between said first point and said second point of the other of said levers.

7. A power wrench as defined in claim 6, wherein a distance between said second point and said third point of one of said levers is equal to a distance between said second point and said third point of the other of said levers.

8. A power wrench as defined in claim 1, wherein each of said levers includes two lever plates spaced from one another in direction of said axes and surrounding said end.

9. A power wrench as defined in claim 1, wherein each of said pawls has two pawl plates spaced from one another in the direction of said axes and surrounding said ratchet.

10. A power wrench as defined in claim 9, wherein said pawl plates of one of said pawls are straight while said pawl plates of the other of said pawls are curved.

11. A power wrench as defined in claim 1; and further comprising a housing including two housing plates which are spaced from one another in the direction of said axes and surrounding said links, said pawls and said ratchet.

12. A power wrench as defined in claim 1; and further comprising a housing for supporting said drive means, said engaging means, and said ratchet mechanism, said housing being wedge-shaped in direction toward said ratchet.

13. A power wrench as defined in claim 12, wherein said piston has an axis, said housing being symmetrical relative to said axis of said piston, said end of said piston being connected with said levers in a point located on said axis.

14. A power wrench as defined in claim 1; and further comprising means for connecting said cylinder with a source of a fluid medium and including a connector, said drive means having an axis, said connector being arranged turnably around said axis.

15. A power wrench as defined in claim 14, wherein said connector has two parts which are swivellable relative to one another, one of said parts being arranged turnably relative to said axis, while the other of said parts being arranged turnably relative to said one part about an axis extending perpendicularly to said axis of said drive means.

16. A power wrench as defined in claim 15, wherein said parts have inner passages communicating with one another, said one part having an outlet open into said cylinder, said other part having two inlets connectable with a source of said fluid medium for supplying said fluid medium into and withdrawing the same from said connector.

17. A power wrench as defined in claim 1; and further comprising a reaction member arranged to react against a neighboring object during tightening and loosening a threaded connector, said ratchet having a ratchet axis, said reaction member having a first portion which is coaxial with said ratchet and adjustably connectable with the latter, and a second portion extending from said first portion radially and axially relative to said ratchet axis, so that said second portion can be located at either side of said ratchet axis in an area of 360° around said ratchet axis.

18. A power wrench as defined in claim 1, wherein each of said pawls includes two pawl plates spaced from one another in the direction of said axis and a pin connecting said pawl plates with one another and engageable with said ratchet.

* * * * *